US009555339B2

(12) United States Patent
Lu

(10) Patent No.: US 9,555,339 B2
(45) Date of Patent: Jan. 31, 2017

(54) BUILDING BLOCK SYSTEM AND BUILDING BLOCK UNITS THEREOF

(71) Applicant: XIAMEN SUNNYPET PRODUCTS CO., LTD, Xiamen (CN)

(72) Inventor: Kongzhi Lu, Xiamen (CN)

(73) Assignee: XIAMEN SUNNYPET PRODUCTS CO., LTD, Xiamen (CN)

( * ) Notice: Subject to any disclaimer, the term of this patent is extended or adjusted under 35 U.S.C. 154(b) by 70 days.

(21) Appl. No.: 14/436,081

(22) PCT Filed: Mar. 4, 2015

(86) PCT No.: PCT/CN2015/073632
§ 371 (c)(1),
(2) Date: Apr. 15, 2015

(87) PCT Pub. No.: WO2016/015470
PCT Pub. Date: Feb. 4, 2016

(65) Prior Publication Data

US 2016/0271508 A1 Sep. 22, 2016

(30) Foreign Application Priority Data

Jul. 30, 2014 (CN) ..... 2014 1 0368610
Jan. 14, 2015 (CN) ..... 2015 2 0024124 U
Jan. 14, 2015 (CN) ..... 2015 2 0024153 U

(51) Int. Cl.
*A63H 33/10* (2006.01)
*A63H 33/08* (2006.01)

(52) U.S. Cl.
CPC ..... *A63H 33/08* (2013.01); *A63H 33/10* (2013.01); *A63H 33/105* (2013.01)

(58) Field of Classification Search
CPC ..... A63H 33/04; A63H 33/10; A63H 33/105; A63H 33/108
See application file for complete search history.

(56) References Cited

U.S. PATENT DOCUMENTS 604,708 A * 5/1898 Burton ..... A63H 33/105 446/110
1,142,471 A * 6/1915 White ..... A63H 33/105 405/259.3

(Continued)

FOREIGN PATENT DOCUMENTS

CN 203208698 U 9/2013
CN 103505887 A 1/2014

*Primary Examiner* — John Ricci
(74) *Attorney, Agent, or Firm* — Gokalp Bayramoglu

(57) ABSTRACT

A building block, comprises a plurality of basic units and a plurality of connectors. Each connector is used to connect each two basic units. The basic unit is a hexahedron. Each face is set with a plurality of connecting holes and a slot. The connector inserts into one connecting hole on one face of the basic unit, and comes out from another connecting hole on the opposing face through the slot to connect with another basic unit. The connecting design not only increases the ways of connecting each two basic units, but also ensures that one basic unit has at least one connecting hole for connecting with another basic unit. The present invention is help to cultivate children's ability of multiple perspectives thinking and ability of 3D space thinking.

9 Claims, 18 Drawing Sheets

(56) References Cited

U.S. PATENT DOCUMENTS

| | | | | | |
|---|---|---|---|---|---|
| 1,281,856 | A * | 10/1918 | Shaw | A63H 33/105 | 211/189 |
| 1,608,592 | A * | 11/1926 | Funk | A63H 33/107 | 211/189 |
| 3,603,026 | A * | 9/1971 | Kishigami | A63H 33/108 | 446/122 |
| 5,924,906 | A * | 7/1999 | Grafton | A63H 33/10 | 411/339 |
| 6,322,414 | B1 * | 11/2001 | Lin | A63H 33/10 | 446/122 |

* cited by examiner

BUILDING BLOCK SYSTEM AND BUILDING BLOCK UNITS THEREOF

FIELD OF THE INVENTION

The present invention relates to the field, of toys. Specifically, the present invention refers to a kind of building block and building block units thereof.

BACKGROUND OF THE INVENTION

Human brains develop fastest during infancy. And tactile manipulation of objects can promote the development of infant brains. At present, there is a few intelligence related toys on the market, such as puzzles, magic cubes, building blocks. Among these, children deeply love building blocks because children can assemble and disassemble building blocks as they wish with only their imagination as a limit.

In a Chinese patent published as CN 1035058874A, an atomic building block was disclosed. The atomic building block has a plurality of faces on which there are a plurality of interfaces. According to different types of interfaces, elements of the atomic building block can be categorized into two classes, elements with convex interfaces and elements with concave interfaces. By combining convex interfaces with concave interfaces of the atomic building block, 3-D assembly can be realized and children can build many forms and structures. However, because there are two kinds of atomic building blocks, children have to classify them. Many infants fail to conduct 3-D assembly because infants cannot distinguish between the two classes of the atomic building blocks.

In a Chinese patent published as CN 203208689U, a building block was disclosed. The building block comprises a base and a connector, wherein the base is a hexahedron whose top face is installed with fixing holes and whose bottom face, left face, right face, front face and back face are all installed with connecting holes matching the connector. This kind of building block enables children to assemble without classifying the building block. However, when the building block is used to build bottles and cans, the base has to reserve fixing holes to connect with bottles and cans. As a result, the base cannot extend to each side of the building block discretionally. Therefore, the extension of the base is limited. In addition, because the left face, the right, face, the front face, the back face and the bottom face are all installed with only one connecting holes, it's difficult to connect the five faces with the connector at the same time. Furthermore, when a connector is not inserted into its location deep enough, it results in a loose connection between the faces of the base, and the connector can easily move and separate from its location. If the connector is inserted into a connection hole too deep, the other connecting holes cannot be connected.

SUMMARY OF THE INVENTION

The present invention discloses a building block and building block units thereof, in order to overcome the issues stated above.

The technical solutions of the invention is as follows:

Technical Solution 1:

A building block system, comprises a plurality of basic units and a plurality of connectors used for connecting two basic units. The basic unit is a hexahedron, wherein each side face of the basic unit is evenly set with four connecting holes, and each face of the basic unit is also set with a slot.

Connecting holes on each two opposing faces are connected by slots on the other four faces. The connector goes into the connecting hole on one side face, and comes out from the connecting hole on the opposing face through the slot to connect with another basic unit.

Preferably, the basic unit stated above is a cube, wherein each connecting hole stated above is set at the inner side of each face's side edge and the slot is set at from the central of the face extending to each connecting hole.

Further, the connector is a flat cuboid. The cross section of the connecting hole is a rectangle, wherein the long side of the rectangle is parallel to the corresponding side edge. The connecting hole is adjacent to the inner side of the slot and is interlinked with the slot mutually. All bottom faces of the slots together compose a small cube.

In a first preferable embodiment according to the connecting way stated above, the undersurface of the connector is set with a first strip-type slot along the length direction. Two ends of the connector's undersurface are set with two second strip-type slots which are perpendicular to the first strip-type slot. Each face of the small cube is set with a raised cross to match with the first strip-slot and the second strip-type slot.

In a second preferable embodiment according to the connecting way stated above, each face of the small cube is set with a pin hole. Each end of the connector is set with a location hole. The connector is fixed to the basic unit through inserting the locating pin into the location hole and the pin hole.

In a third preferable embodiment according to the connecting way stated above, the undersurface of the connector is set with a raised line along the length direction. Each face of the small cube is set with a plurality of strip-type slots to match with the raised line. The raised line is set with a plurality of recesses. The strip-type slot is set with a plurality of raised portions to match with the recesses.

Moreover, each end of the connector is set with a through-hole. A disassembling tool can disassemble the building block quickly and conveniently by cooperating with the through-holes. The length of the connector is double of the length of the side edge of the cube.

Technical Solution 2:

A building block unit, comprises an incomplete cube unit and a connector. The incomplete cube unit is set with a cutting part. The cutting part is obtained by cutting a complete cube through a cutting path. The cutting path begins from two side edges of a vertex on a side face and extends directly to corresponding side edges of the opposite vertex. Among the incomplete faces, each of the two opposing faces is set with two connecting holes, each of the two adjacent faces is set with one connecting hole. The remaining two complete adjacent faces is set with four connecting holes. The connecting holes on one face are interlinked to the corresponding connecting holes on the opposing face. One end of the connector is inserted into the two interlinked connecting holes, and the other end comes out from the side face of the incomplete cube unit.

In one preferable embodiment, the cutting part is a right-angle triangular prism. Two rectangular faces of the right-angle triangular prism are portions of two mutually perpendicular side faces of the incomplete cube unit. The end face of the right-angle triangular prism is a right triangle. The two endpoints of the hypotenuse of the right triangle can be any point on the two adjacent, side edges excluding the endpoints of the adjacent side edge. Preferably, the two endpoints of the hypotenuse of the right triangle are the midpoints of two adjacent side edges.

In another preferable embodiment, the cutting part comprises a cutting face. The cutting face is an arc face. The endpoints of the arc face's arc line can be any point on the two adjacent side edges excluding the endpoints of the adjacent side edges. Preferably, the two endpoints of the arc face's arc line are the midpoints of two adjacent side edges.

The cross section of the connecting hole is a rectangle, wherein the long side of the rectangle is parallel to the corresponding side edge.

Each of the remaining two complete adjacent faces is set with a slot. The connecting hole is set along the side face of the slot. The connecting hole is adjacent to the slot and interpenetrate with the slot to form a cross slot.

Technical Solution 3

A building block unit, comprises an incomplete cube unit and a connector. The incomplete cube unit is set with an unfilled corner. The unfilled corner is achieved by cutting three adjacent side faces of a complete cube unit and includes the common vertex of the three adjacent side faces. Each of the remaining three side faces of the incomplete cube unit is evenly set with four first connecting holes. Each of the three incomplete side faces is set with two second connecting holes. The second connecting holes are interlinked with the corresponding first connecting holes on the opposing side face. One end of the connector is inserted into the two interlinked first and second connecting holes, and the other end comes out from the side face of the incomplete cube unit.

In one embodiment, the unfilled corner further comprises an arc face, wherein the arc face is formed by three vertexes, wherein each two vertexes are opposing on one side face. The arc face is part of an inscribed sphere of the incomplete cube unit.

The cross section of the connecting hole is a rectangle, wherein the long side of the rectangle is parallel to the corresponding side edge.

Each side face of the incomplete cube unit is set with a slot in the center of the side face. The first connecting holes and the second connecting holes are set along the side face of the slot. The first connecting hole is adjacent to the inner side of the slot and interpenetrate with the slot to form a cross slot. The second connecting hole is adjacent to the inner side of the slot and interconnected with the slot to form an L-shape slot. All bottom faces of the slots together compose a small cube.

In another embodiment, the unfilled corner comprises a bevel, which is formed by three vertexes, and each two of the three vertexes are opposing on one side face.

Each of the three square side faces of the incomplete cube unit is set with a slot in the central of the side face. The first connecting holes and the second connecting holes are set along the side face of the slot. The first connecting hole is adjacent to the inner side of the slot and interpenetrate with the slot to form a cross slot.

In the two embodiments stated above, the bottom face of each slot is set with a raised cross.

BENEFITS OF THE INVENTION

1. Each face of the building block unit is evenly set with a plurality of connecting holes. The connecting holes on each two opposing faces are correspondingly interlinked by the slots on the other four faces. The connector inserts into one connecting hole on one face of the basic unit, and comes out from another connecting hole on the opposing face through the slot to connect with another basic unit. The connecting design not only increases the ways of connecting each two basic units, but also overcomes the clash when more than one connector inserts into the connecting holes. The present invention is help to cultivate children's ability of multiple perspectives thinking and ability of 3D space thinking.

2. The basic unit is a cuboid structure. Each face of the cube is the same. One basic unit can extend along any face of another basic unit, which can combine various shapes of building blocks, and meets the needs of children's curiosity.

3. Each face of the basic unit is set with a slot. The slot interlinks two opposing connecting holes. The bottom faces of the slots compose a small cube. The bottom face of the slot is not only used for supporting the connector, but also used for conducting the connector to insert into the connecting hole, which is convenient for connecting the connector and the basic unit.

4. The connector is set with a raised line and a plurality of recesses. The raised line not only increases the connector's strength, but also guides the connection. Otherwise, cooperation of the recesses and raised portions makes the connection between the basic unit and the connector firmer without slippage or sliding.

5. Various styles of building blocks are obtained after combination. Moreover, the side faces of the building blocks can be arc faces or with the structure of multiple side edges and corners, which brings children different experiences, meets the needs of children's curiosity, cultivates children's ability of multiple perspectives thinking and ability of 3D space thinking.

PREFERRED EMBODIMENT OF THE PRESENT INVENTION

Figure 1:
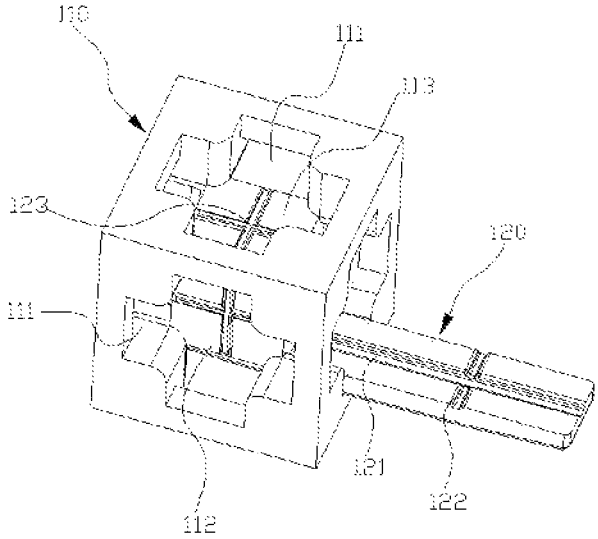
FIG. 1 is a structure diagram of the preferred embodiment of the present invention.
Figure 2:
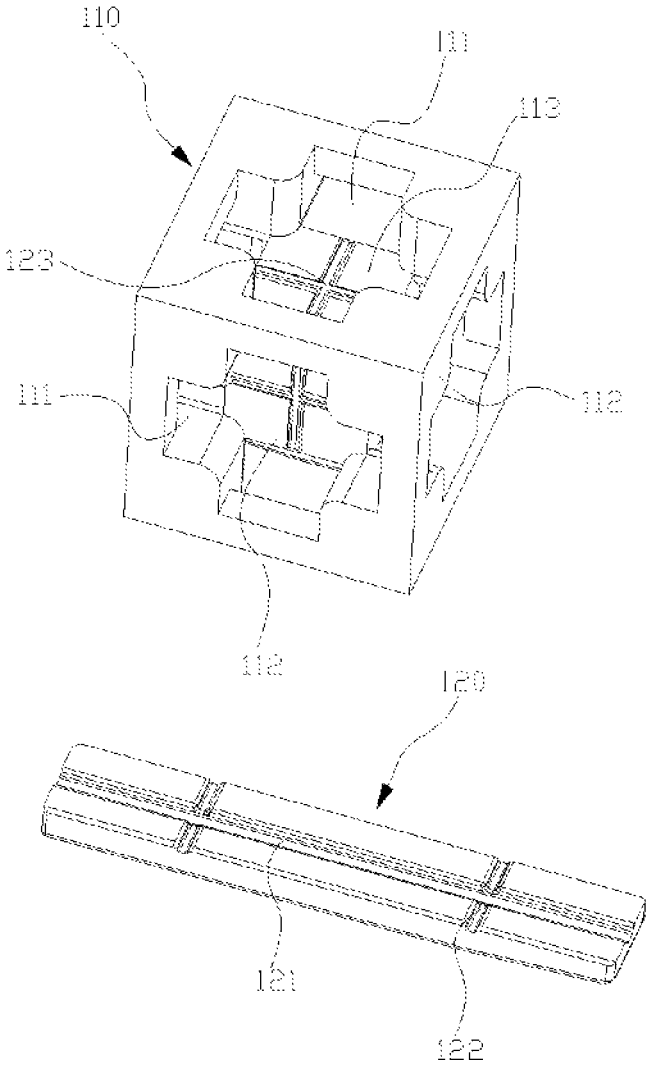
FIG. 2 is a decomposition diagram of the preferred embodiment of the present invention.

A building block system, according to FIG. 1 and FIG. 2, comprises a plurality of basic units 110 and a plurality of connectors 120, wherein each connector 120 is used to connect each two basic units 110. The basic unit is a hexahedron. In this embodiment, the basic unit is a cube. Connecting hole 111 is set at the inner side of each face's side edge. The cross section of connecting hole 111 is a rectangle, wherein the long side of the rectangle is parallel to the corresponding side edge. Each face of basic unit is set with a slot 112. Connecting holes 111 on each two opposing faces are connected by slots 112 on the other four faces. Slot 112 is set at from the central of the face extending to each connecting hole 111. Connecting hole 111 is adjacent to the inner side of slot 112 and is interlinked with slot 112 mutually. The bottom faces of slots 112 compose a small cube 113. The bottom face of slot 112 is not only used for supporting connector 120, but also used for conducting connector 120 to insert into connecting hole 111, which is convenient for connecting connector 120 and basic unit 110.

According to FIG. 2, connector 120 a flat cuboid. The undersurface of connector 120 is set with a first strip-type slot 121 along the length direction. Two ends of the connector's undersurface are set with two second strip-type slots 122 which are perpendicular to first strip-type slot 121. Each face of small cube 113 is set with a raised cross 123 which matches with first strip-type slot 121 and second strip-type slot 122. Connector 120 inserts into one connecting hole 111 on one face of the basic unit and comes out from another connecting hole 111 on the opposing face through slot 112 to connect with another basic unit. The connecting design not only increases the ways of connecting each two basic units 110, but also ensures that one basic unit 110 has at least one connecting hole 111 for connecting with another basic unit 110.

DETAILED DESCRIPTION OF THE EMBODIMENTS

Figure 3:
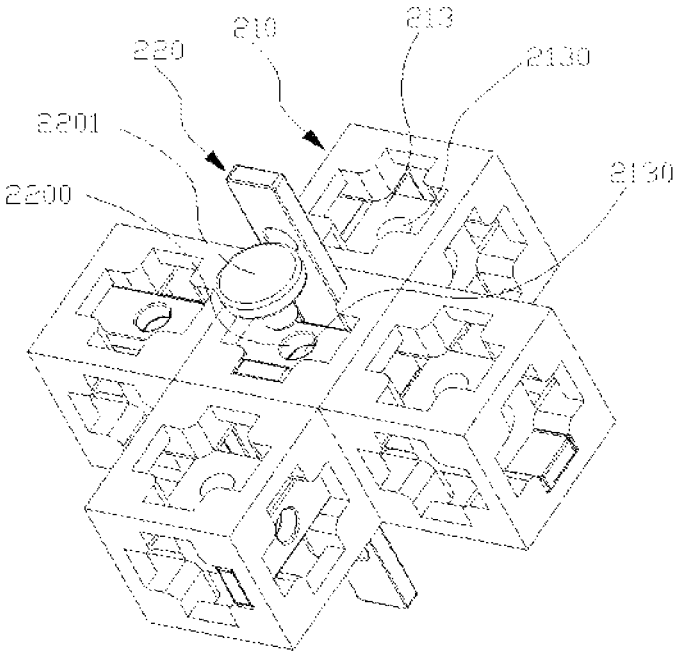
FIG. 3 is an assembly structure diagram of a second embodiment of the present invention.

A second embodiment of the invention is basically the same with the preferred embodiment. According to FIG. 3, the difference between the second embodiment and the preferred embodiment is the connecting way between connector 220 and basic unit 210. In this embodiment, each face of small cube 213 is set with a pin hole 2130. Each end of connector 220 is set with a location hole 2200. Connector 220 is fixedly connected to basic unit 210 through inserting locating pin 2201 into location hole 2200 and pin hole 2130. This embodiment uses a location mode with locating pin 201, location hole 2200, and pin hole 130 to make the connection between basic units 10 firmer.

Figure 4:
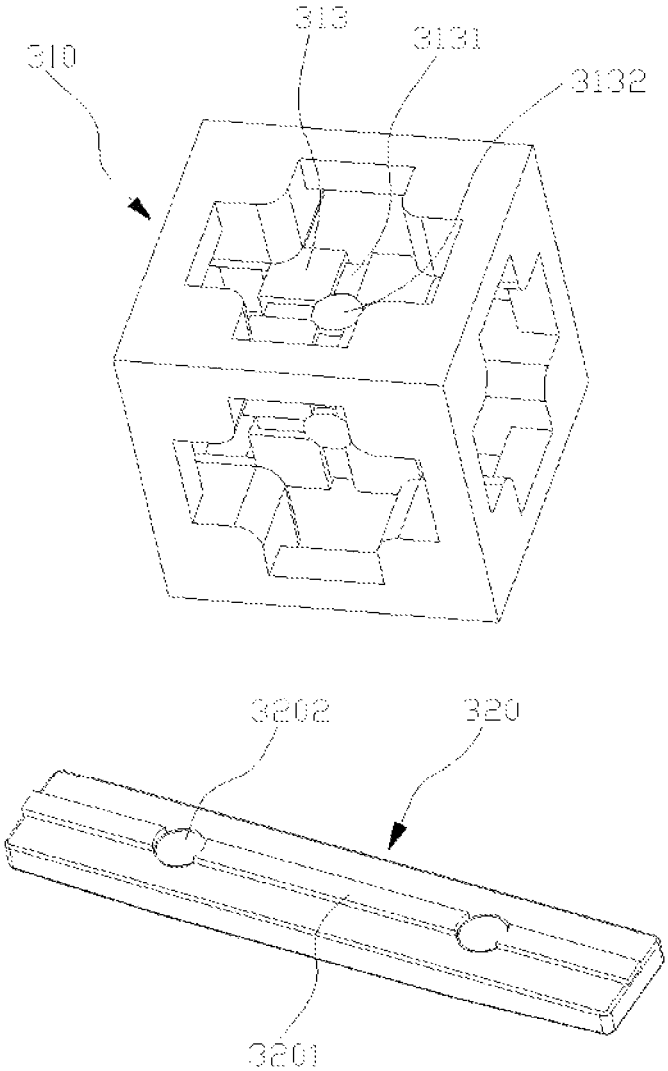
FIG. 4 is a decomposition diagram of a third embodiment of the present invention.

The difference between a third embodiment and the preferred embodiment and the second embodiment is the connecting way between connector 320 and basic unit 310. According to FIG. 4, in this embodiment, the undersurface (or topsurface) of connector 320 is set with a raised line 3201 which extends along the length direction. Each face of small cube 313 is set with a plurality of strip-type slots 3131 to match with raised line 3201. Raised line 3201 is also set with a plurality of recesses 3202. Strip-type slot 3131 is set with a plurality of raised portions 3132 which match with recesses 3202. In this embodiment, connector 320 is set with a raised line 3201 and a plurality of recesses 3202. Raised line 3201 not only increases connector's strength, but also conducts the connection. Otherwise, cooperation of recesses 3202 and raised portions 3132 makes the connection between basic unit 310 and connector 320 firmer without relative sliding.

To clarify, in the embodiments stated above, two ends of connectors can also be set with through-holes. A disassembling tool can disassemble the building block quickly and conveniently by cooperating with the through-holes.

Figure 5:
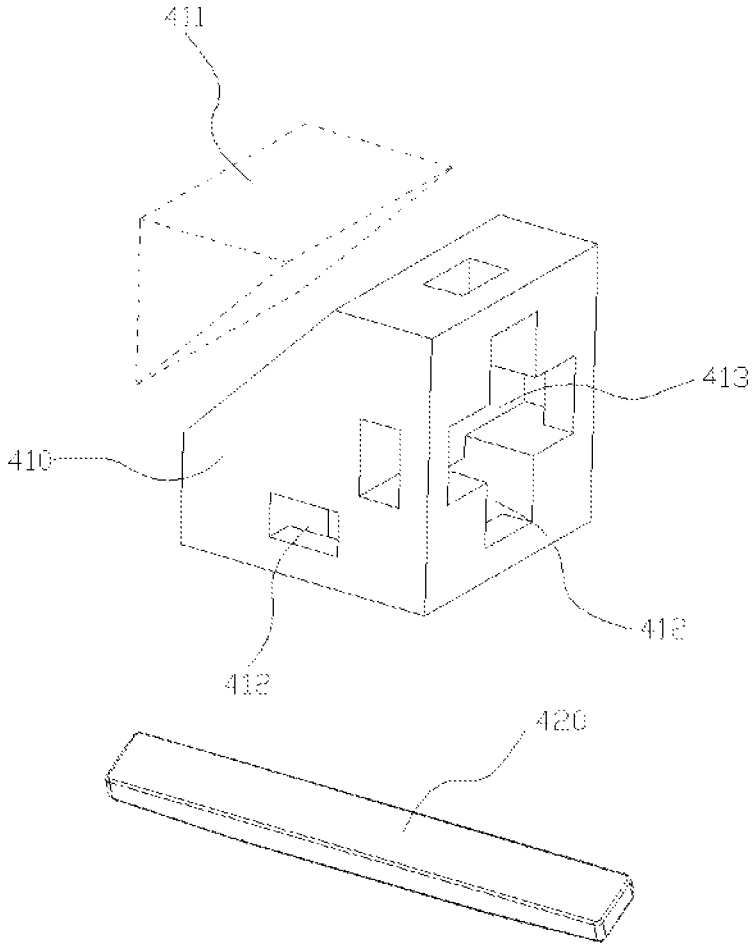
FIG. 5 is a structure diagram of a fourth embodiment of the present invention.

In a fourth embodiment, according to FIG. 5, a basic unit comprises an incomplete cube unit 410 and a connector 420. Incomplete cube unit 410 is set with a cutting part 411. The cutting part can be obtained by cutting a complete cube through a cutting path. The cutting path begins from two side edges of a vertex on a side face and extends directly to the corresponding side edges of the opposite vertex. In this embodiment, cutting part 411 is a right-angle triangular prism. Two rectangular faces of right-angle triangular prism 411 are portions of mutually perpendicular side faces of incomplete cube unit 410. The end face of right-angle triangular prism 411 is a right triangle. One endpoint of the hypotenuse of the right triangle can be any point on one side edge excluding the endpoints of the side edge. The other endpoint of the hypotenuse of the right triangle can be any point on the adjacent side edge excluding the endpoints of the adjacent side edge. Preferably, two endpoints of the hypotenuse of the right triangle are the midpoints of two adjacent side edges. Among the incomplete faces, each of the two opposing faces is set with two connecting holes 412, each of the two adjacent faces is set with one connecting hole 412. Each of the remaining two complete adjacent faces is set with a slot 413 in the center. Four connecting holes 412 are set around slot 413. The cross section of connecting hole 412 is a rectangle, wherein the long side of the rectangle is parallel to the corresponding side edge. Four connecting holes 412 stated above are adjacent to the inner side of slot 413 and interpenetrate with slot 413 to form a cross slot. Connecting holes 412 on one face stated above are interlinked to the corresponding connecting holes 412 on the opposing face, which ensures the side faces of incomplete cube unit 410 have two interlinked connecting holes to connect with other building block units. One end of connector 420 stated above is inserted into the two interlinked connecting holes, and the other end comes out from the side face of the incomplete cube unit.

Figure 6:
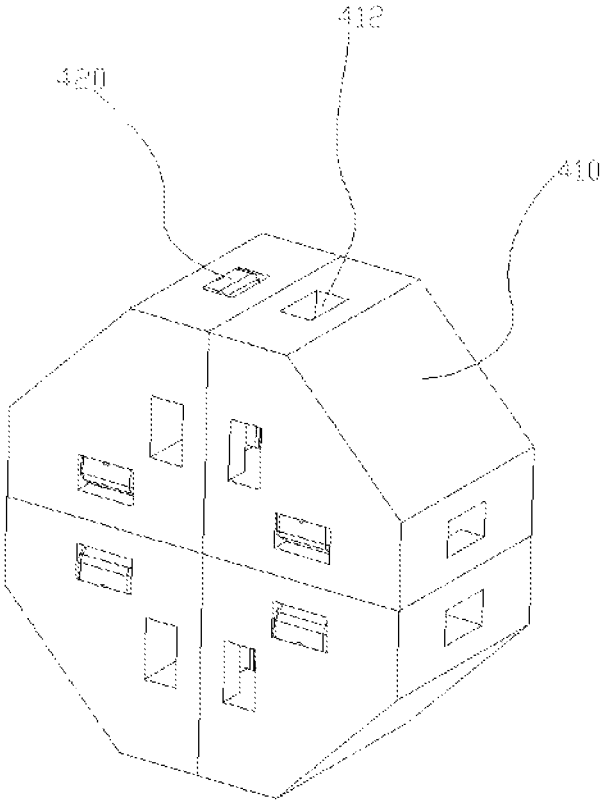
FIG. 6 is an assembled structure schematic of the fourth embodiment of the present invention.
Figure 7:
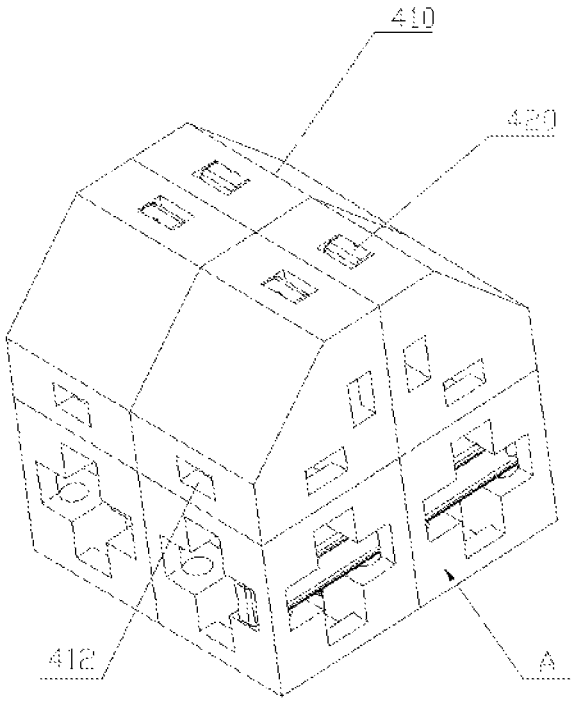
FIG. 7 is an assembled structure schematic of the fourth embodiment and a cube unit.

In FIG. 6, four building blocks are connected together. The side faces with four connecting holes 412 are jointly connected with each other. Each cutting face is located at the side face. After connection, a polyhedron with a plurality of edges and angles is achieved, which is more aesthetical. Moreover, according to FIG. 7, the incomplete cube unit can also connect with cube units which has six same side faces, which diversifies the combinations and cultivates children's ability of multiple perspectives and ability of 3D space thinking.

Figure 8:
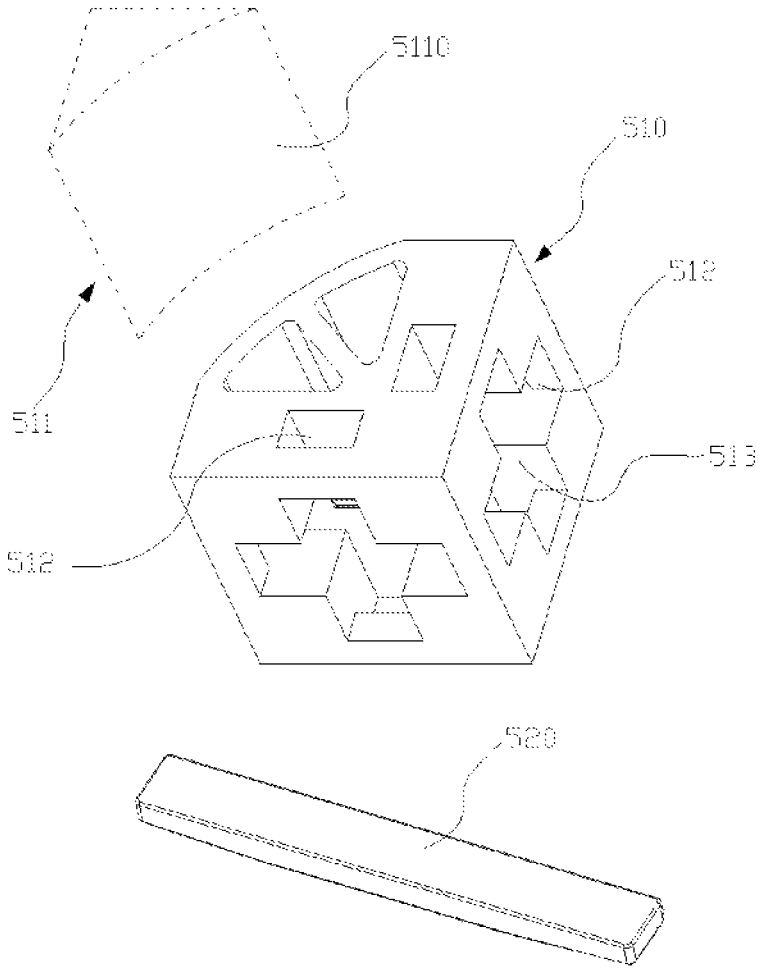
FIG. 8 is a structure diagram of a fifth embodiment of the present invention.

In a fifth embodiment, according to FIG. 8, a building block unit comprises an incomplete cube unit 510 and a connector 520. Incomplete cube unit 510 is set with a cutting part 511. In this embodiment, cutting part 511 comprises a cutting face 5110. Cutting face 5110 is an arc face. One endpoint of the arc face's arc line can be any point on one side edge excluding the endpoints of the side edge. The other endpoint of the arc face's arc line can be any point on the adjacent side edge excluding the endpoints of the adjacent side edge. Preferably, two endpoints of the arc face's arc line are the midpoints of two adjacent side edges. Among the incomplete faces, each of the two opposing faces is set with two connecting holes 512, each of the two adjacent faces is set with one connecting hole 512. Each of the remaining two complete adjacent faces is set with a slot 513 in the central. Four connecting holes 512 are evenly set around slot 513. The cross section of connecting hole 512 is a rectangle, wherein the long side of the rectangle is parallel to the corresponding side edge. Four connecting holes 512 stated above are adjacent to the inner side of slot 513 and interpenetrate with slot 513 to form a cross slot. Connecting holes 512 on one face stated above are interlinked to the corresponding connecting holes 512 on the opposing face, which ensures the side faces of incomplete cube unit 510 have two interlinked connecting holes to connect with other building block units. One end of connector 520 stated above is inserted into the two interlinked connecting holes, and the other end comes out from the side face of the incomplete cube unit.

Figure 9:
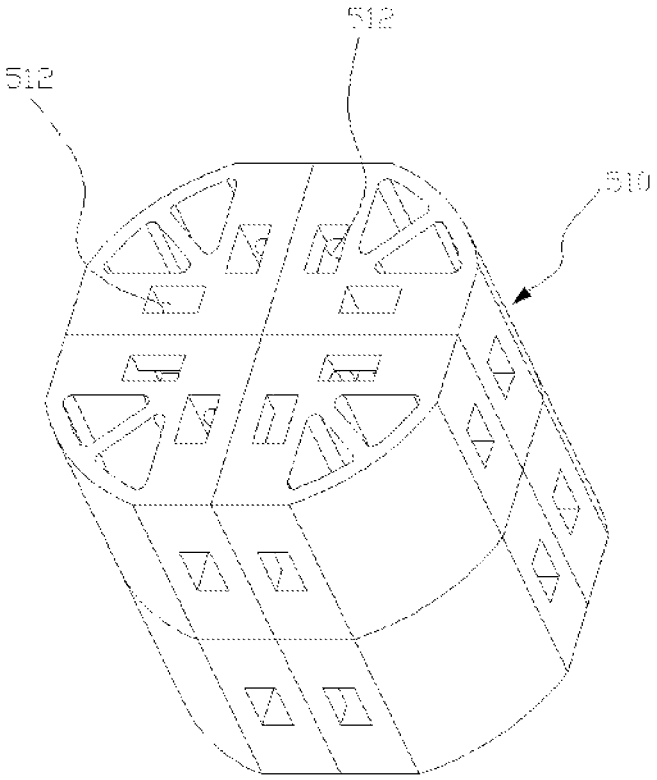
FIG. 9 is an assembled structure schematic of the fifth embodiment of the present invention.
Figure 10:
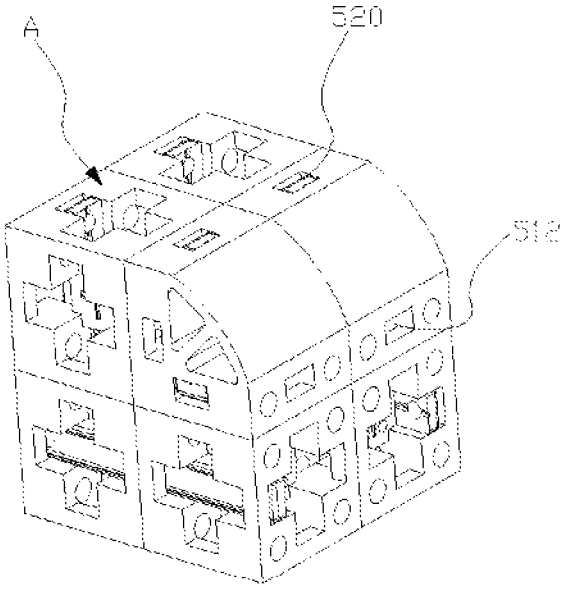
FIG. 10 is an assembled structure schematic of the fifth embodiment and a cube unit.

According to FIG. 9, eight building blocks are connected together. Each cutting face acts as one side face. After connection, a cylinder is achieved. Moreover, according to FIG. 10, the incomplete cube unit can also connect with cube units A, which diversifies the combinations and cultivates children's ability of multiple perspectives thinking and ability of 3D space thinking.

The connecting design between connector 520 and connecting hole 512 can adopt the connecting way using a raised line and a slot. This connecting way is a general technique in this field and will not be described in detail.

Figure 11:
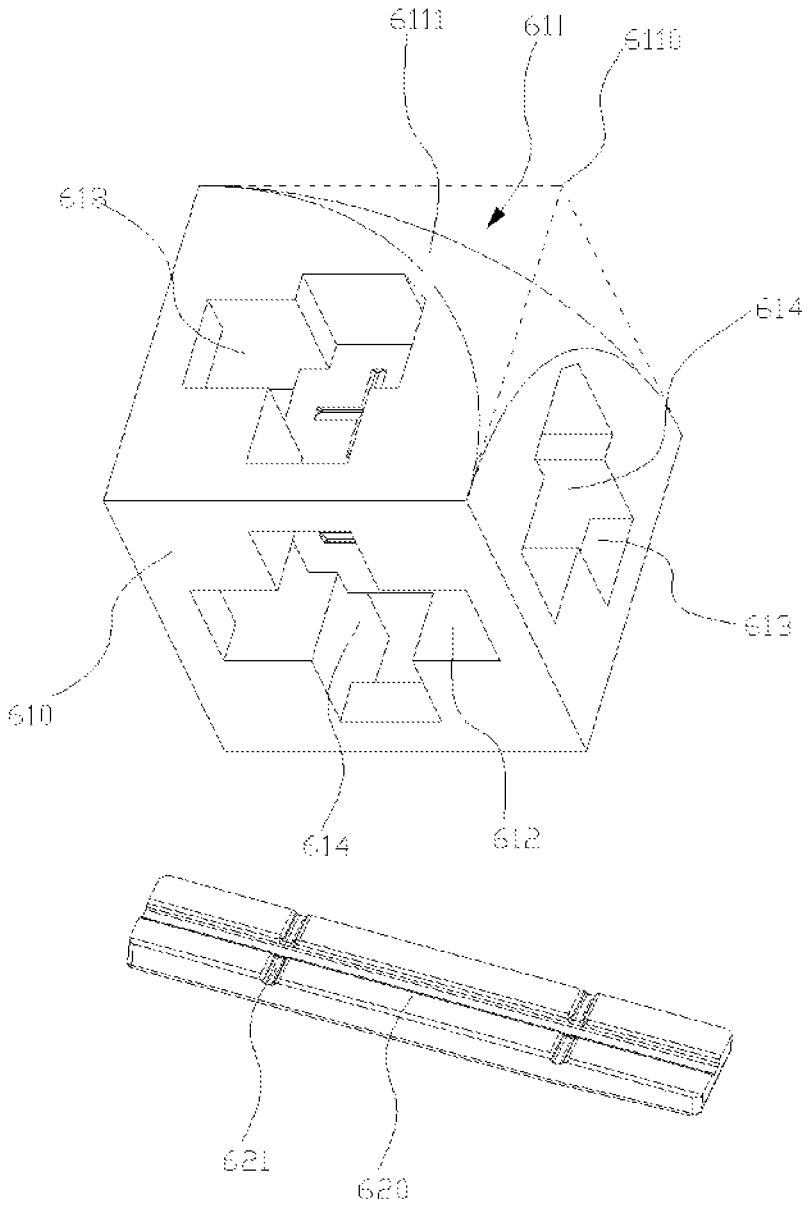
FIG. 11 is a structure schematic of a sixth embodiment of the present invention.
Figure 12:
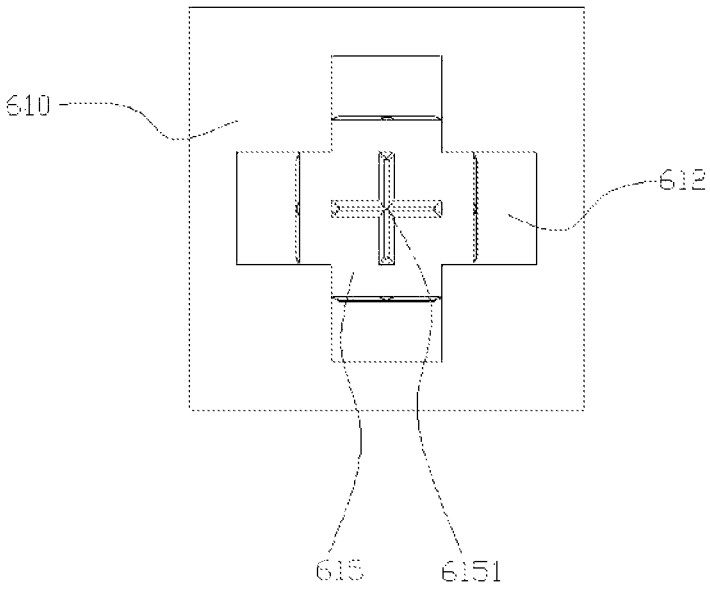
FIG. 12 is a rear view of the sixth embodiment of the present invention.

In a sixth embodiment, according to FIG. 11 and FIG. 12, a building block unit comprises an incomplete cube unit 610 and a connector 620. Incomplete cube unit 610 is set with an unfilled corner 611. Unfilled corner 611 is achieved by cutting three adjacent side faces of a complete cube unit. In this embodiment, unfilled corner 611 comprises a common vertex 6110 of the three adjacent side faces and an arc face 6111. Arc face 6111 is formed by three vertexes, wherein each two vertexes are opposing on one side face. Arc face 6111 is part of an inscribed sphere of said cube unit. Each of the remaining three side faces of incomplete cube unit 610 is evenly set with four first connecting holes 612. Each of the three incomplete side faces is set with two second connecting holes 613. Second connecting holes 613 are interlinked with corresponding first connecting holes 612 on the opposing face. One end of the connector 620 stated above is inserted into the first connecting hole and the second connecting hole, and the other end comes out from the side face of the incomplete cube unit. Each side face of incomplete cube unit 610 is set with a slot 614 in the central of the side face. First connecting hole 612 and second connecting hole 613 are set along the side face of slot 614. First connecting hole 612 is adjacent to the inner side of slot 614 and interpenetrate with slot 614 to form a cross slot. Second connecting hole 613 is adjacent to the inner side of slot 614 and interpenetrate with slot 614 to form an L-shape slot. All bottom faces of slots compose a small cube 615. The central of each side face of small cube 615 is set with a raised cross 6151. Connector 620 stated above is correspondingly set with a cross slot 621 which matches raised cross 6151.

Figure 13:
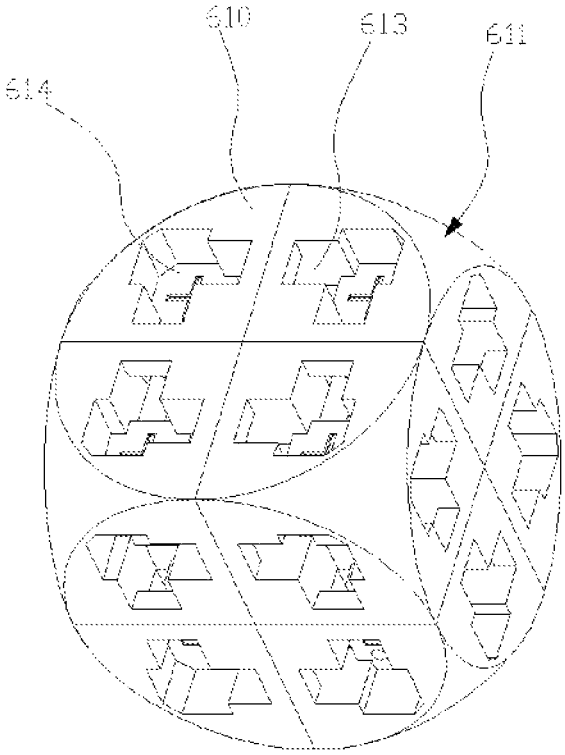
FIG. 13 is an assembled structure schematic of the sixth embodiment of the present invention.
Figure 14:
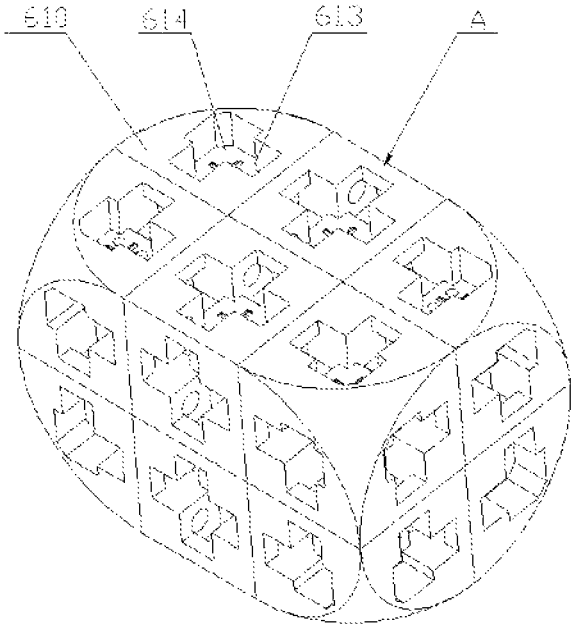
FIG. 14 is an assembled structure schematic of the sixth embodiment and a cube unit.

According to FIG. 13, eight same building blocks are connected together. Unfilled corners are located at eight vertexes of a regular hexahedron. After connection, each corner and each edge are cambered. Moreover, according to FIG. 14, this building block can also connect with cube units which has six same side faces, which diversifies the combination and cultivates children's ability of multiple perspectives thinking and ability of 3D spatial thinking.

Figure 15:
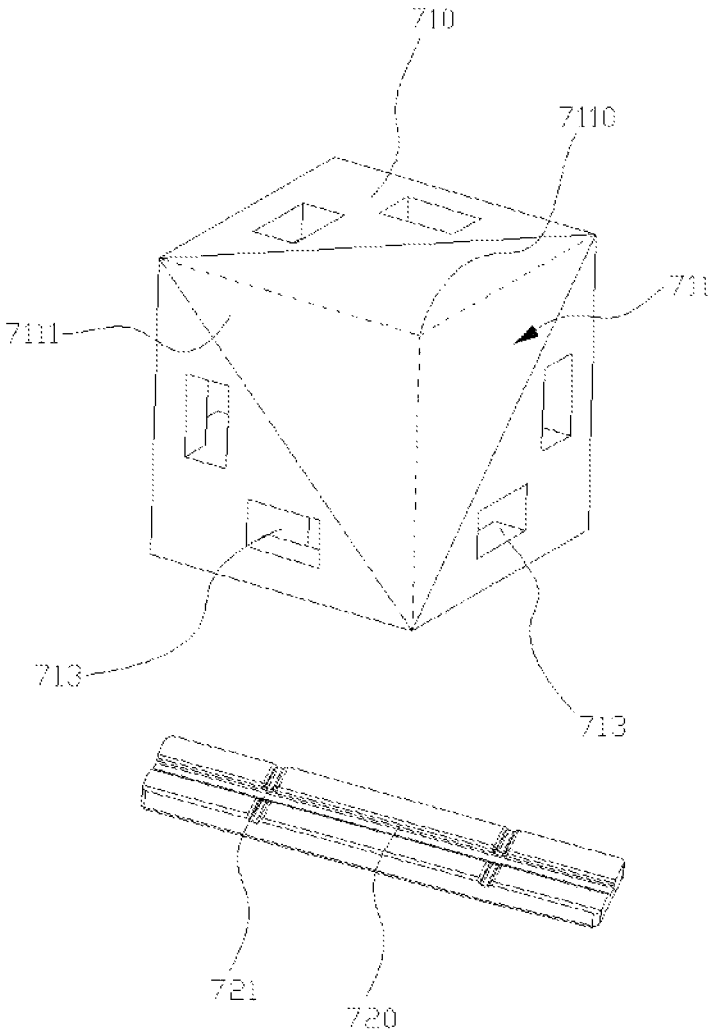
FIG. 15 is a structure schematic of a sixth embodiment of the present invention.
Figure 16:
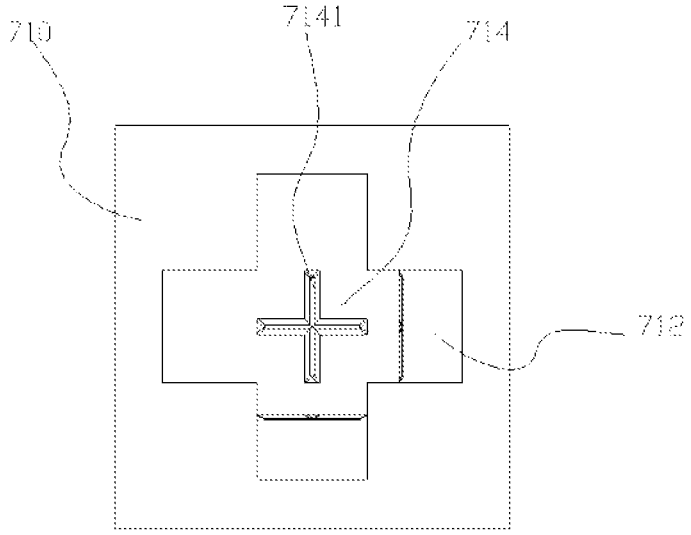
FIG. 16 is a rear view of the seventh embodiment of the present invention.

In a seventh embodiment, according to FIG. 15 and FIG. 16, a building block unit comprises an incomplete cube unit 710 and a connector 720. Incomplete cube unit 710 is set with an unfilled corner 711. Unfilled corner 711 is achieved by cutting three adjacent side faces of a cube unit. In this embodiment, unfilled corner 711 comprises a common vertex 7110 of the three adjacent side faces and a bevel 7111. Bevel 7111 is formed by three vertexes, wherein each two vertexes are opposing on one side face. Each of the remaining three side faces of incomplete cube unit 710 is evenly set with four first connecting holes 712. Each of the three incomplete side faces is set with two second connecting holes 713. Second connecting holes 713 are interlinked with corresponding first connecting holes 712 on the opposing face. Each of three square side faces is set with a slot 714 in the central of the side face. First connecting hole 712 is evenly set along the side face of slot 714. First connecting hole 712 is adjacent to the inner side of slot 714 and interpenetrate with slot 714 to form a cross slot. The bottom face of said slot stated above is set with a raised cross 7141. Connector 720 is set with a cross slot 721 which matches with raised cross 7141.

Figure 17:
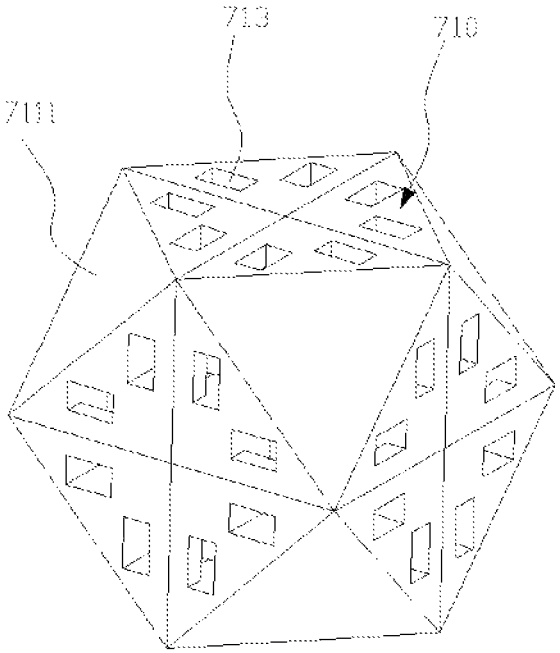
FIG. 17 is an assembled structure schematic of the seventh embodiment of the present.
Figure 18:
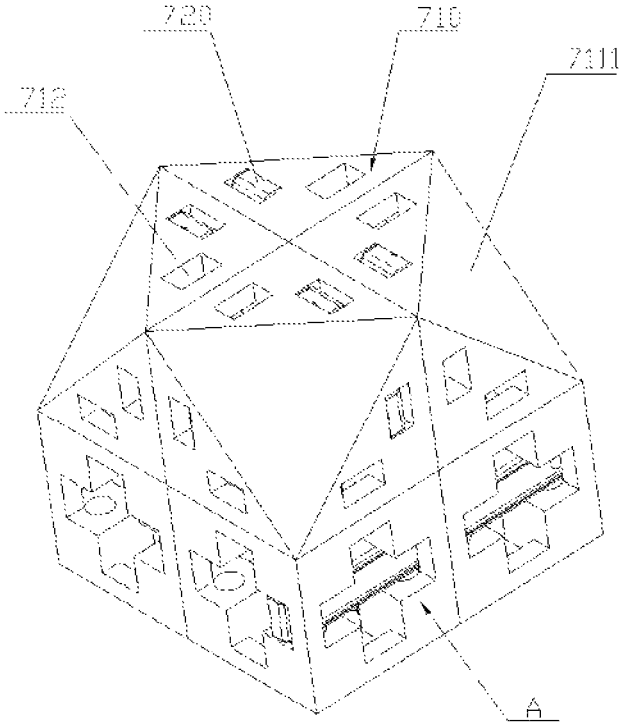
FIG. 18 is an assembled structure schematic of the seventh embodiment and a cube unit.

According to FIG. 17, eight same building blocks are connected together. Unfilled corners are located at eight vertexes of a regular hexahedron. After connection, a polyhedron with multiple corners and edges is obtained, which is more aesthetical. Moreover, according to FIG. 18, this building block can also connect with cube units which has six same side faces, which diversifies the combination and cultivates children's ability of multiple perspectives thinking and ability of 3D space thinking.

The invention claimed is:

1. A building block system, comprising:

a plurality of basic units and a plurality of connectors;

wherein the basic units are hexahedrons;

wherein each of the connectors is used to connect two basic units;

wherein each face of the basic units is evenly set with at most four connecting holes;

wherein each face of the basic unit is set with a slot;

wherein the connecting holes on each two opposing faces are correspondingly connected by the slots of the other four faces;

wherein the connector inserts into one connecting hole on one face of the basic unit, and comes out from another connecting hole on the opposing face through the slot to connect with another basic unit.

2. The building block system of claim 1, further wherein the basic unit is a cube; further wherein the connecting hole is correspondingly set at the inner side of each face's side edge; further wherein the slot is set at from the central of the face to the each connecting hole.

3. The building block system of claim 2, further wherein the connector is a flat cuboid; further wherein the cross section of connecting hole is a rectangle; further wherein the long side of the rectangle is parallel to the corresponding side edge of the cube; further wherein the connecting hole is adjacent to the inner side of the slot and is interlinked with the slot mutually, further wherein bottom faces of the slots compose a small cube.

4. The building block system of claim 3, further wherein the undersurface of the connector is set with a first strip-type slot along the length direction, further wherein two ends of the connector's undersurface are set with two second strip-type slots which are perpendicular to the first strip-type slot, further wherein each face of the small cube is set with a raised cross which matches with the first strip-type slot and the second strip-type slots.

5. The building block system of claim 3, further wherein each face of the small cube is set with a pin hole, further wherein each end of the connector is set with a location hole, further wherein the connector is fixedly connected to the basic unit through inserting a locating pin into the location hole and the pin hole.

6. The building block system of claim 3, further wherein the undersurface of the connector is set with a raised line, further wherein each face of the small cube is set with a strip-type slot which matches with the raised line.

7. The building block system of claim 6, further wherein the raised line is set with a plurality of recesses, further wherein the strip-type slot is set with a plurality of raised portions which match with the recesses.

8. The building block system of claim 3, further wherein each end of the connector is set with a through-hole for easy disassembly.

9. The building block system of claim 2, further wherein the length of the connector is double of the length of the side edge of the cube.

* * * * *